US010227540B2

(12) United States Patent
Iida et al.

(10) Patent No.: US 10,227,540 B2
(45) Date of Patent: Mar. 12, 2019

(54) POWDER LUBRICANT COMPOSITION AND METHOD FOR MANUFACTURING SEAMLESS STEEL PIPE

(71) Applicant: NIPPON STEEL & SUMITOMO METAL CORPORATION, Tokyo (JP)

(72) Inventors: Sumio Iida, Tokyo (JP); Masami Imamura, Tokyo (JP); Takayuki Fukushima, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 395 days.

(21) Appl. No.: 14/412,783

(22) PCT Filed: Aug. 13, 2013

(86) PCT No.: PCT/JP2013/071862
§ 371 (c)(1),
(2) Date: Jan. 5, 2015

(87) PCT Pub. No.: WO2014/027655
PCT Pub. Date: Feb. 20, 2014

(65) Prior Publication Data

US 2015/0191670 A1 Jul. 9, 2015

(30) Foreign Application Priority Data

Aug. 13, 2012 (JP) ..... 2012-179474

(51) Int. Cl.
*C10M 125/26* (2006.01)
*C10M 169/04* (2006.01)
(Continued)

(52) U.S. Cl.
CPC ..... *C10M 125/26* (2013.01); *B21B 17/02* (2013.01); *B21B 19/04* (2013.01); *B21B 23/00* (2013.01);
(Continued)

(58) Field of Classification Search
CPC ..... B21B 25/04; B21B 19/04; B21B 17/02; B21B 23/00; B21B 45/0242;
(Continued)

(56) References Cited

U.S. PATENT DOCUMENTS 4,052,323 A 10/1977 Feneberger et al.
4,710,307 A * 12/1987 Periard ..... C10M 103/00 252/79
(Continued)

FOREIGN PATENT DOCUMENTS

CA 1 239 139 A 7/1988
JP 50-144868 A 11/1975
(Continued)

OTHER PUBLICATIONS

International Search Report, dated Oct. 29, 2013, issued in PCT/JP2013/071862.
(Continued)

*Primary Examiner* — Debra Sullivan
(74) *Attorney, Agent, or Firm* — Birch, Stewart, Kolasch & Birch, LLP

(57) ABSTRACT

A powder lubricant composition according to the present invention includes 65 parts by mass to 95 parts by mass of sodium borate, and 5 parts by mass to 35 parts by mass of cryolite. A method for manufacturing a seamless steel pipe according to the present invention includes adhering the above-described powder lubricant composition to a pipe inner surface of a work piece which is piercing rolled to have a tubular shape, and elongation rolling on the work piece after the adhering of the powder lubricant composition.

10 Claims, 3 Drawing Sheets

(51) Int. Cl.

| | |
|---|---|
| ***B21B 23/00*** | (2006.01) |
| ***B21B 17/02*** | (2006.01) |
| ***C10M 125/18*** | (2006.01) |
| ***B21B 19/04*** | (2006.01) |
| ***B21B 25/04*** | (2006.01) |
| ***C10M 103/06*** | (2006.01) |
| *B21B 45/02* | (2006.01) |

(52) U.S. Cl.
CPC ..... *B21B 25/04* (2013.01); *C10M 103/06* (2013.01); *C10M 125/18* (2013.01); *C10M 169/04* (2013.01); *B21B 45/0242* (2013.01); *C10M 2201/081* (2013.01); *C10M 2201/0873* (2013.01); *C10N 2240/403* (2013.01); *C10N 2250/08* (2013.01)

(58) Field of Classification Search
CPC ..... B21B 45/0263; C10M 125/26; C10M 103/06; C10M 125/18
See application file for complete search history.

(56) References Cited

U.S. PATENT DOCUMENTS

| | | | | |
|---|---|---|---|---|
| 6,024,808 | A * | 2/2000 | Kondo | B21B 23/00 148/541 |
| 2007/0157691 | A1 * | 7/2007 | Iida | B21B 17/04 72/41 |

FOREIGN PATENT DOCUMENTS

| | | | |
|---|---|---|---|
| JP | 61-37989 | A | 2/1986 |
| JP | 64-16894 | A | 1/1989 |
| JP | 6-172854 | A | 6/1994 |
| JP | 7-84667 | B2 | 9/1995 |
| JP | 2002-338985 | A | 11/2002 |
| JP | 3855300 | B2 | 12/2006 |

OTHER PUBLICATIONS

Written Opinion of the International Searching Authority, dated Oct. 29, 2013, issued in PCT/JP2013/071862.

* cited by examiner

POWDER LUBRICANT COMPOSITION AND METHOD FOR MANUFACTURING SEAMLESS STEEL PIPE

TECHNICAL FIELD OF THE INVENTION

The present invention relates to a method for manufacturing a seamless steel pipe in which a hollow blank pipe is elongation rolled, and more specifically, relates to a powder lubricant composition for hot working which is used by being supplied to an inner surface of the hollow blank pipe during elongation rolling, and a method for manufacturing a seamless steel pipe using the same.

Priority is claimed on Japanese Patent Application No. 2012-179474, filed on Aug. 13, 2012, the content of which is incorporated herein by reference.

RELATED ART

In the manufacturing of a seamless steel pipe by the Mannesmann-mandrel mill process, a round billet is heated in a heating furnace and thereafter pierced by a piercing mill to produce a hollow shell (hollow blank pipe). Next, a mandrel bar having a lubricant applied to the surface is inserted into the hollow blank pipe, which is skewered with the mandrel bar, and the hollow shell is further subjected to elongation rolling by a mandrel mill including 5 to 9 stands. Thus, a pipe is obtained. The pipe from which the mandrel bar is drawn after the elongation rolling is reheated in a reheating furnace as required after a distorted portion of the pipe end is cut by a hot saw. The outer surface of the reheated pipe is subjected to descaling with high pressure water, the outer diameter and the thickness of the pipe are then slightly reduced by a stretch reducer, and the final size is determined. The pipe whose final size has been determined is cooled on a cooling bed and then is cut to a predetermined length by a cold saw and sent to a refining line.

Among the above-described steps, a lubricant is generally applied to the surface of the mandrel bar in elongation rolling the hollow blank pipe by the mandrel mill. The lubricant is applied to prevent seizure from occurring between the inner surface of the hollow blank pipe and the outer surface of the mandrel bar.

During elongation rolling, relative slippage occurs between the inner surface of the hollow blank pipe and the outer surface of the mandrel bar, and thus, when a lubrication state at the interface between the inner surface of the hollow blank pipe and the outer surface of the mandrel bar is not preferable, the seizure occurs between the hollow blank pipe and the mandrel bar. As a result, a steel pipe having good inner surface quality cannot be obtained. Therefore, a lubricant is applied to the outer surface of the mandrel bar to stably secure a low friction coefficient between the hollow blank pipe and the mandrel bar such that the seizure can be prevented from occurring between the hollow blank pipe and the mandrel bar.

As the lubricant that is applied to the outer surface of the mandrel bar, a lubricant including graphite as a main component as disclosed in Patent Document 1, and a lubricant including mica as a main component as disclosed in Patent Document 2 are known. Further, in recent years, as disclosed in Patent Document 3, it has been proposed that a lubricant which includes borax as a main component is supplied to an inner surface of a hollow blank pipe for melting scales on the inner surface so as to improve the quality of the inner surface of the hollow blank pipe.

On the other hand, in recent years, as disclosed in Patent Document 4, for the purpose of improving the strength and the toughness of a product, a technique of thermomechanical treatment which causes grains of steel to be finer through high working at a relatively low temperature has been investigated. A technique obtained by combining the technique of thermomechanical treatment and a method for manufacturing a seamless steel pipe, specifically, a technique of performing elongation rolling such as mandrel mill rolling at a low temperature of lower than 1000° C., has not been yet put into practical use.

For example, in Patent Document 5, when elongation rolling is performed by a mandrel mill at a temperature range of 1000° C. or lower, it is pointed out that problems of defects such as surface flaws occur frequently in finished products, difficulties in drawing the mandrel bar, and the like, which do not arise in typical steel plate rolling, arise. The reason why these problems arise is that a load on the mandrel bar is increased due to an increase in the deformation strength of a material to be rolled, and even when a lubricant including borax as a main component is supplied to the inner surface, an increase in a friction coefficient cannot be suppressed and flaws are generated on the inner surface of the pipe.

In Patent Document 6, there is disclosed a powder lubricant composition that is used in mandrel mill rolling performed at 1000° C. to 1300° C. using a mandrel bar whose surface is plated with Cr. The powder lubricant composition includes sodium borate and fluorite. However, the powder lubricant composition was invented to improve the corrosion resistance of the outer surface of the mandrel bar. The use of the powder lubricant composition in thermomechanical treatment at a temperature of lower than 1000° C. is not disclosed in Patent Document 6. Further, the fluorite included in the powder lubricant composition has high hardness and thus a powder supply nozzle for supplying the powder lubricant composition to the surface of the mandrel bar is worn.

In Patent Document 7, there is disclosed a pickling agent (treatment agent) for performing pickling in seamless steel pipe manufacturing equipment and functioning as a lubricant and an antioxidant. The pickling agent includes one or more compounds selected from a group A consisting of $Na_2B_4O_7$-$10H_2O$, $Na_2B_4O_7$-$10H_2O$, $Na_2B_4O_7$-$5H_2O$, anhydrous $Na_2B_4O_7$, sodium metaborate, boric acid, boric acid anhydride, soluble sodium silicate, sodium metasilicate, and the like, and one or more compounds selected from a group B consisting of one or more dry graphite lubricants, calcium fluoride, cryolite, antimony oxide, molybdenum disulfide, boron nitride, and phosphate, and functions as a solid lubricant. However, as the raw materials for the aforementioned treatment agent, compounds which melt when being used at a temperature around 1000° C., that is, which cannot function as a solid lubricant, are included. It seems that the function of a pickling agent disclosed in Patent Document 7 as a lubricant has not been sufficiently investigated. In addition, it is not preferable to use a solid lubricant to achieve an object of the present invention. When mandrel mill rolling is performed by using a solid lubricant, the solid lubricant causes fine scratches to be formed on the inner surface of the steel pipe, and the quality of the inner surface of the steel pipe is deteriorated.

PRIOR ART DOCUMENT

Patent Document

[Patent Document 1] Japanese Unexamined Patent Application, First Publication No. S50-144868

[Patent Document 2] Japanese Unexamined Patent Application, First Publication No. S64-016894

[Patent Document 3] Japanese Examined Patent Application, Second Publication No. H07-084667

[Patent Document 4] Japanese Unexamined Patent Application, First Publication No. H06-172854

[Patent Document 5] Japanese Patent Publication No. 3855300

[Patent Document 6] Japanese Unexamined Patent Application, First Publication No. 2002-338985

[Patent Document 7] Japanese Examined Patent Application, Second Publication No. H7-84667

DISCLOSURE OF THE INVENTION

Problems to be Solved by the Invention

An object of the present invention is to provide a powder lubricant composition for hot working capable of, even when elongation rolling such as mandrel mill rolling is performed at a relatively low rolling temperature (for example, a rolling temperature of lower than 1000° C.) to manufacture a seamless steel pipe by, for example, a Mannesmann-mandrel mill process, reducing fraction on the inner surface of the pipe and suppressing flaw generation on the inner surface of the pipe by supplying the powder lubricant composition to the inner surface of the pipe. In addition, another object of the present invention is to provide a method for manufacturing a seamless steel pipe using the powder lubricant composition for hot working.

Means for Solving the Problem

The present inventors have conducted repeated investigations regarding the cause of not suppressing a friction increase or flaw generation on an inner surface of a pipe even when a conventional lubricant including sodium borate as a main component is supplied to the inner surface of the pipe in elongation rolling at a rolling temperature of lower than 1000° C. As a result, the inventors have found that sodium borate does not melt sufficiently on the inner surface of the pipe at a rolling temperature of lower than 1000° C. and the unmelted sodium borate causes an increase in friction on the inner surface of the pipe. The inventors have established countermeasures against this phenomenon in which (A) a substance having properties of melting scales on the inner surface of the pipe and having a lower melting point than that of sodium borate is employed as a lubricant material, or in which (B) sodium borate or the substance described in (A) and a substance which lowers the melting point of the sodium borate or the substance described in (A) are used in combination.

As an alternative substance for sodium borate matching with the above-described condition of (A), boric acid or sodium chloride is assumed to be useable. However, boric acid has a defect that the lubrication capacity is inferior to that of sodium borate and thus it is difficult to include boric acid as a main component of the lubricant. Further, since chlorides such as sodium chloride cause corrosion of steel, the quality of a product may be affected by the use of chlorides.

As a substance meeting the above-described condition of (B), carbonates and the like such as sodium carbonate or fluoride salts such as fluorite $CaF_2$, cryolite $Na_3[AlF_6]$, and the like can be considered. However, sodium carbonate causes a problem when being used in combination with sodium borate. Sodium borate which is glassy and colorless immediately after the steel pipe is manufactured has properties of absorbing moisture with time and becoming whitened. Sodium carbonate has properties of facilitating the above-described properties. Accordingly, it is not preferable to contain a large amount of sodium carbonate when being used in combination with sodium borate from the viewpoint of an outer appearance of a product. On the other hand, it has been found that inclusion of fluoride salts deteriorates the lubrication capacity at a temperature lower than 1000° C. in some cases. In addition, it has been found that among the fluoride salts, fluorite has higher hardness and thus a powder supply nozzle for supplying a lubricant is worn, which may interfere with realization of the manufacturing method using the lubricant.

As a result of further intensive investigations, the inventors have found that a good lubrication capacity can be stably exhibited in both a low temperature range of lower than 1000° C., in which sodium borate hardly melts, and a high temperature range of 1000° C. or higher, in which the amount of scales generated increases, by controlling an amount of cryolite with respect to an amount of sodium borate to be within an appropriate range, and thus, the present invention has been accomplished.

(1) A first aspect according to the present invention is a powder lubricant composition including 65 parts by mass to 95 parts by mass of sodium borate, and 5 parts by mass to 35 parts by mass of cryolite.

In the present invention, the concept of "sodium borate" includes sodium salts of oxyacids of boron in which an oxidation number is +III, and hydrates thereof. The concept of "oxyacids of boron in which an oxidation number is +III" includes condensed boric acids such as diboric acid $H_4B_2O_5$, triboric acid $H_5B_3O_7$, tetraboric acid $H_6B_4O_9$, and metaboric acid $HBO_2$ in addition to orthoboric acid $H_3BO_3$. For example, the "sodium salts of oxyacids of boron in which an oxidation number is +III, and hydrates thereof" includes anhydrous sodium tetraborate $Na_2B_4O_7$, sodium tetraborate pentahydrate $Na_2B_4O_7$-$5H_2O$ (more specifically, $Na_2B_2O_5(OH)_4$-$3H_2O$), and sodium tetraborate decahydrate $Na_2B_4O_7$-$10H_2O$ (more specifically, $Na_2B_2O_5(OH)_4$-$8H_2O$; also referred to as "borax" in the following description) within a range in which the oxyacid of boron is tetraboric acid.

The amount (parts by mass) of "sodium borate" means the total mass including water of hydration when the sodium borate is a hydrate in the description. Further, when multiple types of sodium borates are included, the amount (parts by mass) of "sodium borate" means the total amount of the multiple types of sodium borates in the description.

(2) A second aspect according to the present invention is a method for manufacturing a seamless steel pipe including adhering the powder lubricant composition according to the first aspect of the present invention to a pipe inner surface of a work piece which is piercing rolled to have a tubular shape, and elongation rolling on the work piece after the adhering of the powder lubricant composition.

(3) In the method for manufacturing a seamless steel pipe according to the second aspect of the present invention, a temperature of the work piece before initial rolling in the elongation rolling may be 700° C. or higher and lower than 1000° C. Thus, it is possible to reduce friction when sliding the inner surface of the pipe with the elongation rolling and suppress flaw generation on the inner surface of the pipe.

In the present invention, the "temperature of the work piece before initial rolling in the elongation rolling" means a temperature of the work piece immediately before the elongation rolling starts.

(4) In the method for manufacturing a seamless steel pipe according to (2) or (3), a total reduction in the elongation rolling may be 50% to 80%. According to this aspect, since the work piece is subjected to high working at a relatively low temperature, it is possible to cause the grains of the steel to be finer.

In the present invention, the "reduction" means a reduction ratio of the thickness of the pipe before and after elongation rolling. When the thickness before elongation rolling is defined as $t_0$ and the thickness after elongation rolling is defined as $t_1$, a reduction r in the elongation rolling is expressed by the following Expression 1. In addition, when elongation rolling is performed by a mandrel mill including a plurality of stands, a total reduction of all the stands (that is, the numerator $t_0$-$t_1$ on the right side of Expression 1 represents a total reduction amount of all the stands) is collectively referred to as a total reduction.

$$r=(t_0-t_1)/t_0 \quad \text{(Expression 1)}$$

(5) In the method for manufacturing a seamless steel pipe according to any one of (2) to (4), the elongation rolling may be performed by a mandrel mill rolling.

Effects of the Invention

According to the first aspect of the present invention, it is possible to provide a powder lubricant composition capable of, even when elongation rolling such as mandrel mill rolling is performed at a relatively low rolling temperature in the manufacturing process of the seamless steel pipe, reducing a friction coefficient between the inner surface of the pipe and the outer surface of the mandrel mill and suppressing flaw generation on the inner surface of the pipe by supplying the powder lubricant composition to the inner surface of the pipe.

According to the second aspect of the present invention, the powder lubricant composition according to the first aspect of the present invention is adhered to the pipe inner surface of the work piece and then elongation rolling is performed. Thus, even when the elongation rolling is performed on the steel at a relatively low temperature, it is possible to provide a method for manufacturing a seamless steel pipe capable of reducing friction generated on the inner surface of the pipe during the elongation rolling and suppressing flaw generation on the inner surface of the pipe.

EMBODIMENTS OF THE INVENTION

Figure 1:
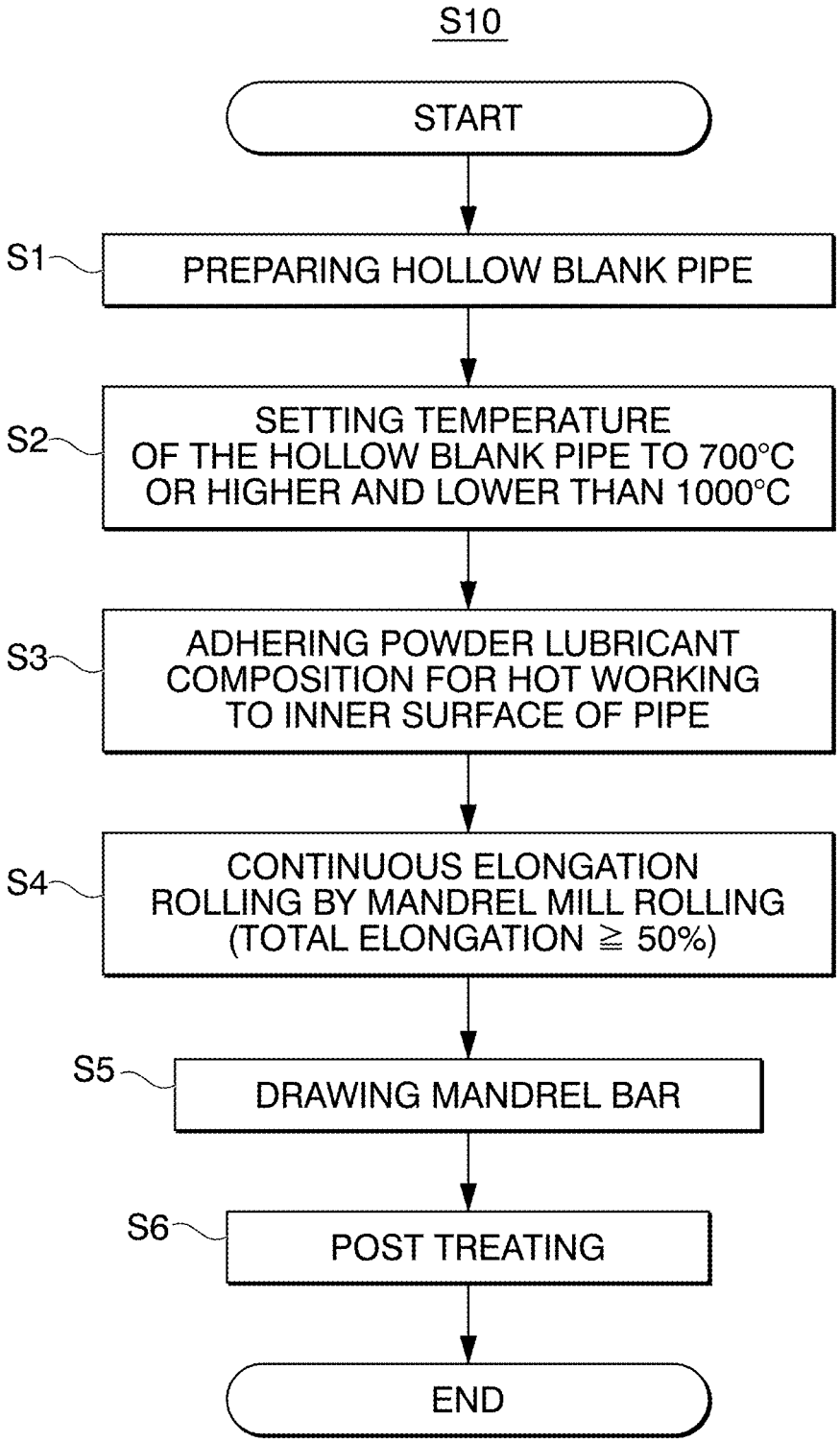
FIG. 1 is a flow chart illustrating one embodiment of a method for manufacturing a seamless steel pipe according to a second aspect of an embodiment.

The above-described actions and effects of the present invention will become apparent from embodiments for carrying out the present invention which will be described later. Hereinafter, the embodiments of the present invention will be described with reference to drawings. The embodiments described below are merely examples of the present invention and the present invention is not limited thereto. In addition, unless otherwise specified, regarding a numerical value range, the expression of "A to B" means "A or more and B or less". In the expression, when a unit is attached only to the numerical value B, it is deemed that the unit is also applied to the numerical value A.

<1. Powder Lubricant Composition>

A powder lubricant composition according to a first aspect of the present invention will be described. The powder lubricant composition of the embodiment includes 65 parts by mass to 95 parts by mass of sodium borate, and 5 parts by mass to 35 parts by mass of cryolite.

(Sodium Borate)

Sodium borate has a function of securing a fluid lubrication capacity and a scale melting capacity. It is preferable that the sodium borate of the embodiment include one or more compounds selected from the group consisting of anhydrous sodium tetraborate $Na_2B_4O_7$, sodium tetraborate pentahydrate $Na_2B_4O_5(OH)_4$-$3H_2O$, and sodium tetraborate decahydrate (borax) $Na_2B_4O_5(OH)_4$-$8H_2O$ from the viewpoint of stability, ease of acquisition, and the like. It is particularly preferable that the powder lubricant composition include anhydrous sodium tetraborate $Na_2B_4O_7$ not containing water of hydration out of the above-mentioned group. When the powder lubricant composition contains anhydrous sodium tetraborate $Na_2B_4O_7$, the powder lubricant composition melts more quickly.

(Cryolite)

Cryolite has a function of sufficiently melting sodium borate at a rolling temperature of lower than 1000° C. which is considered a relatively low temperature in the technical field to exhibit a lubrication capacity by lowering the melting point of the lubricant composition including sodium borate. Accordingly, the lubricant composition according to the embodiment can reduce friction force at a rolling temperature of lower than 1000° C. through a fluid lubrication mechanism.

From the experimental results which will be described later, the inventors have assumed that cryolite has a function of lowering the melting point of the lubricant composition and also lowering the viscosity of the molten material of the sodium borate and the scales so as to adjust the viscosity within a viscosity range suitable for fluid lubrication. As for the mechanism, it may be considered that when sodium borate is changed to a glassy form by melting, fluoride ions F supplied from the cryolite compete with negatively charged oxygen atoms (such as B—$O^-$) and are coordinated with boron atoms, and thus, the molten sodium borate interferes with a process of forming a higher network.

The above-mentioned results can be obtained by adding fluoride salts other than cryolite to the lubricant. However, when a fluoride salt having high hardness relative to other fluoride salts is used, the powder supply nozzle may be worn easily depending on the material of the powder supply nozzle. In order to prevent the wearing of the powder supply nozzle, it is necessary to use a fluoride salt having a Mohs hardness of 3 or lower. Examples of the fluoride salt satisfying the condition include NaF (having a Mohs hardness of 2 to 2.5), cryolite (having a Mohs hardness of 2.5 to 3), and the like. Among them, from the viewpoint of exhibiting a better friction reduction capacity in a low temperature range of lower than 1000° C., cryolite can be particularly preferably used. Contrarily, for example, fluorite $CaF_2$ (having a Mohs hardness of 4) can function as a lubricant. However, since the powder supply nozzle is worn, the use of fluorite $CaF_2$ is not preferable.

(Amount of Sodium Borate and Cryolite)

The lubricant composition of the embodiment includes 65 parts by mass to 95 parts by mass of sodium borate, and 5 parts by mass to 35 parts by mass of cryolite as described above. When a ratio between the amounts of the sodium borate and cryolite is within the above-described ranges, a good lubrication capacity can be stably exhibited in both the low temperature range of lower than 1000° C., in which sodium borate hardly melts alone, and the high temperature range of 1000° C. or higher, in which the amount of scales generated increases.

When elongation rolling is performed at a temperature of lower than 1000° C. using the lubricant composition in which the amount of cryolite is lower than the above-mentioned range, sodium borate does not melt sufficiently and fluid lubrication is not achieved. When fluid lubrication is not achieved, as in a case in which a conventional lubricant is used, an increase in friction and flaw generation on the inner surface of the pipe cannot be suppressed. On the other hand, even when elongation rolling is performed at a temperature of lower than 1000° C. using the lubricant composition in which the amount of cryolite is higher than the above-mentioned range, sodium borate does not melt sufficiently and fluid lubrication is not achieved. The inventors have confirmed through the experiments that even when the amount of cryolite is above or below the above-mentioned appropriate range, sodium borate does not melt sufficiently.

Figure 3:
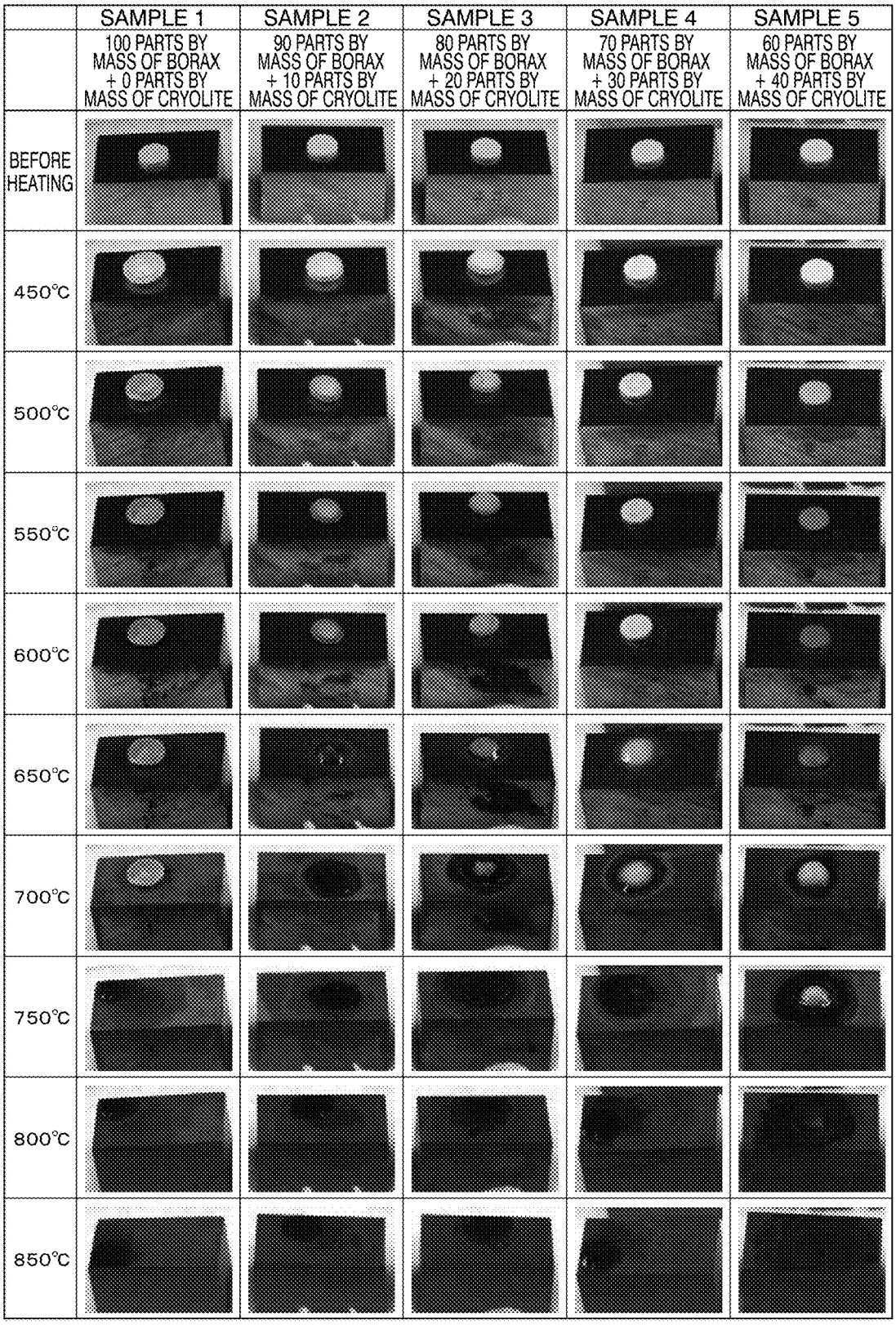
FIG. 3 is a photograph showing a relationship between an amount of cryolite added and a melting starting temperature of sodium borate.

FIG. 3 is a photograph showing experimental results for investigating a relationship between an amount of cryolite added and a melting starting temperature of sodium borate. In this experiment, borax was used as the sodium borate. Sample 1 is a sample including 100 parts by mass of borax and 0 parts by mass of cryolite (that is, a sample including only borax), Sample 2 is a sample including 90 parts by mass of borax and 10 parts by mass of cryolite, Sample 3 is a sample including 80 parts by mass of borax and 20 parts by mass of cryolite, Sample 4 is a sample including 70 parts by mass of borax and 30 parts by mass of cryolite, and Sample 5 is a sample including 60 parts by mass of borax and 40 parts by mass of cryolite. Samples 1 and 5 are samples out of the above-described defined range. When these samples were heated, Sample 1 hardly melted at 700° C., started to melt at about 600° C. to 650° C., and completely melted at 750° C.

Contrarily, Sample 2 started to melt at about 600° C. to 650° C., almost melted at 650° C., and completely melted at 700° C. Sample 3 started to melt at about 600° C. to 650° C., almost melted at 700° C., and completely melted at 750° C. Sample 4 started to melt at about 600° C. to 650° C., almost half melted at 700° C., and completely melted at 750° C. In this manner, Samples 2 to 4 in which the amount of cryolite added was within the defined range melted more clearly and easily compared to Sample 1 in which cryolite was not added.

However, Sample 5 in which the amount of cryolite added was above the defined range did not melt completely even at 800° C. It is assumed that when cryolite is added excessively, cryolite does not melt and Sample 5 does not melt completely until the temperature reaches a high temperature.

In the embodiment, it is more preferable that the amount of sodium borate be set to 75 parts by mass to 85 parts by mass and the amount of cryolite be set to 15 parts by mass to 25 parts by mass.

(Other Components)

In the lubricant composition of the embodiment, as a balance, components other than sodium borate and cryolite may be appropriately contained according to desired properties. Examples of such arbitrary components include a fatty acid sodium salt and/or a fatty acid calcium salt. When the fatty acid sodium salt or the fatty acid calcium salt are contained, the fluidity of the lubricant composition of the embodiment can be improved in a powdered state (that is, before melting). Preferable examples of the fatty acid sodium salt and the fatty acid calcium salt include saturated fatty acid salts such as stearic acid and palmitic acid, fatty acid salts obtained from natural vegetable fats and oils such as palm oil fatty acid, and fatty acid salts obtained from animal fats and oils such as tallow acid. The amount of the fatty acid sodium salt and/or the fatty acid calcium salt is preferably 5 parts by mass or more with respect to 100 parts by mass of the total amount of sodium borate and cryolite from the viewpoint of smooth and easy transfer through the pipe. In addition, from the viewpoint of obtaining economical efficiency and securing a relative amount of sodium borate and cryolite, the amount of the fatty acid sodium salt and/or the fatty acid calcium salt is preferably 25 parts by mass or less, more preferably 20 parts by mass or less, and still more preferably 18 parts by mass or less with respect to 100 parts by mass of the total amount of sodium borate and cryolite.

From the viewpoint of furthering the friction reduction effect and flaw generation suppressing effect, the total amount of sodium borate and cryolite in the lubricant composition of the embodiment is preferably 80 mass % or more, more preferably 83 mass % or more, and still more preferably 85 mass % or more when the total amount of the lubricant composition of the embodiment is 100 mass %. The total amount of sodium borate and cryolite may be 100 mass %. However, from the viewpoint of easily exhibiting the effect resulting from other additive components (for example, the fatty acid salts shown as examples), the total amount thereof is preferably 95 mass % or less.

<2. Method for Manufacturing Seamless Steel Pipe>

A method for manufacturing a seamless steel pipe according to a second aspect of the present invention will be described. FIG. 1 is a flow chart illustrating one example of a method S10 for manufacturing a seamless steel pipe (hereinafter, abbreviated to a "manufacturing method S10"). As illustrated in FIG. 1, the manufacturing method S10 has sequential steps S1 to S6. Hereinafter, with reference to FIG. 1, the manufacturing method S10 will be described.

(Piercing Rolling S1)

In a piercing rolling S1, a hollow blank pipe is prepared by performing piercing rolling on a round billet, which is heated to a predetermined temperature, to have a tubular shape. When the S1 is performed, known piercing rolling methods such as the Mannesmann method can be adopted without being particularly limited. As described below, the hollow blank pipe may be heated to a temperature of 700° C. or higher and lower than 1000° C. in the piercing rolling S1.

(Heating S2)

In a heating S2, the hollow blank pipe prepared in the piercing rolling S1 is heated to a temperature of 700° C. or higher and lower than 1000° C. Typically, the billet may be heated in the piercing rolling S1 so that the temperature of the hollow blank pipe before initial rolling in the elongation rolling is 700° C. or higher and lower than 1000° C. In this case, the heating S2 is included in the piercing rolling S1. Further, when the hollow blank pipe which has undergone the piercing rolling S1 is cooled, the heating S2 can be performed by reheating the hollow blank pipe in a heating furnace.

(Adhering Powder Lubricant Composition S3)

In adhering a powder lubricant composition S3, the powder lubricant composition according to the first aspect of the embodiment is adhered to the inner surface of the hollow blank pipe whose temperature has been adjusted through heating in the piercing rolling S1 or the heating S2. As a method for adhering the powder lubricant composition to the inner surface of the hollow blank pipe, for example, a method of blowing the powder lubricant composition from one open end of the hollow blank pipe with a carrier gas such as nitrogen can be used. The powder lubricant composition adhered to the inner surface of the hollow blank pipe melts by absorbing heat from the hollow blank pipe and forms a lubricating film on the inner surface of the pipe. When the hollow blank pipe is reheated in the heating furnace in the heating S2, the adhering the powder lubricant composition S3 may be performed before the heating S2.

(Elongation Rolling S4)

In an elongation rolling S4, the hollow blank pipe, which has undergone the adhering the powder lubricant composition S3, is elongation rolled with a total reduction being 50% or more by mandrel mill rolling. The elongation rolling may be continuous elongation rolling in which elongation rolling is continuously performed.

First, a mandrel bar in which a lubricant is applied to the surface is inserted into a hollow portion of the hollow blank pipe which has undergone the adhering the powder lubricant composition S3. As the lubricant to be applied to the surface of the mandrel bar, known lubricants such as a lubricant including graphite as a main component as described in Patent Document 1, a lubricant including mica as a main component as described in Patent Document 2, and the like may be appropriately adopted.

Next, the hollow blank pipe into which the mandrel bar is inserted is elongation rolled by a mandrel mill. In the elongation rolling S4, elongation rolling is performed on the hollow blank pipe whose temperature before initial rolling in the mandrel mill is 700° C. or higher and lower than 1000° C. so as to have a total reduction of 50% or more. A plurality of stands (typically, 5 to 9) is generally provided in the mandrel mill. The specific distribution of the reduction in each stand can be appropriately set depending on the number of stands or the like. It is not necessary to particularly define the upper limit of the total reduction. However, in consideration of equipment capability, the upper limit of the total reduction is practically 80%.

In this manner, it is possible to cause the grains of the pipe to be finer by performing significant plastic deformation at a relatively low temperature of lower than 1000° C. Since significant plastic deformation is performed at a relatively low temperature, the condition for sliding between the inner surface of the hollow blank pipe and the outer surface of the mandrel bar is a severe condition for lubrication. However, since the powder lubricant composition according to the first aspect of the present invention is supplied to the inner surface of the pipe in the adhering the powder lubricant composition S3, the friction on the inner surface of the pipe can be reduced and flaw generation on the inner surface of the pipe can be suppressed.

(Drawing S5)

In a drawing S5, the mandrel bar is drawn from the pipe which has undergone the elongation rolling S4. Since the powder lubricant composition according to the first aspect of the present invention is supplied to the inner surface of the pipe in the adhering the powder lubricant composition S3, there is no conventional problem in which the drawing of the mandrel is difficult in the drawing S5.

(Post-Treating S6)

In a post-treating S6, post-treating is performed on the pipe from which the mandrel bar has been drawn in the drawing S5. The content of the post-treatment in the post-treating S6 is the same as the content of a post-treatment normally performed after elongation rolling in manufacturing of a seamless steel pipe. As specific conditions of the post-treating, for example, cutting and removing of the end of the pipe, reheating, descaling, and the like are illustrated by an example.

The manufacturing method S10 is completed through S1 to S6.

In the description of the embodiment, the form of the method S10 for manufacturing a seamless steel pipe in which elongation rolling is performed on the hollow blank pipe (work piece), of which the temperature before initial rolling in the mandrel mill is 700° C. or higher and lower than 1000° C., and in which the total reduction is 50% or more, has been illustrated. However, the embodiment is not limited to such a form. A form in which the total reduction is less than 50% in the elongation rolling can be also employed.

In the description of the embodiment, the form of the method S10 for manufacturing a seamless steel pipe in which the temperature of the hollow blank pipe before initial rolling in the elongation rolling is 700° C. or higher and lower than 1000° C. has been illustrated. However, the embodiment is not limited to such a form. A form in which the temperature of the hollow blank pipe before initial rolling in the elongation rolling is 1000° C. or higher can be also employed. In the form, the effects of reducing friction on the inner surface of the pipe and suppressing flaw generation on the inner surface of the pipe are exhibited.

In the description of the embodiment, the form of the method S10 for manufacturing a seamless steel pipe in which the elongation rolling is performed by mandrel mill rolling in S4 has been illustrated. However, the embodiment is not limited to such a form. A form of the method for manufacturing a seamless steel pipe in which the elongation rolling is performed by other methods, for example, plug mill rolling, can be employed. In such a form, the effects of reducing friction on the inner surface of the pipe and suppressing flaw generation on the inner surface of the pipe are also exhibited.

EXAMPLES

Hereinafter, the present invention will be described in more detail below based on Examples and Comparative Examples. However, the present invention is not limited to these examples.

Examples 1 to 5 and Comparative Examples 1 to 4

The effects exhibited by the powder lubricant composition of the present invention will be described based on the evaluation by a hot rolling test.

Examples 1 to 5

Each component shown in Table 1 was mixed by a powder mixer to have a content ratio shown in Table 1. Thus, the powder lubricant composition according to the first aspect of the present invention was prepared. The details of each component are as follows.

Borax: sodium tetraborate decahydrate (manufactured by Kishida Chemical Co., Ltd., having a purity of 98%)

Cryolite: manufactured by Kishida Chemical Co., Ltd., having a purity of 97%

Comparative Examples 1 to 4

Each powder lubricant composition was prepared in the same manner as in Examples 1 to 5 except that the content ratio of each component was changed as shown in Table 1.

[Table 1]

(Hot Rolling Test)

Figure 2:
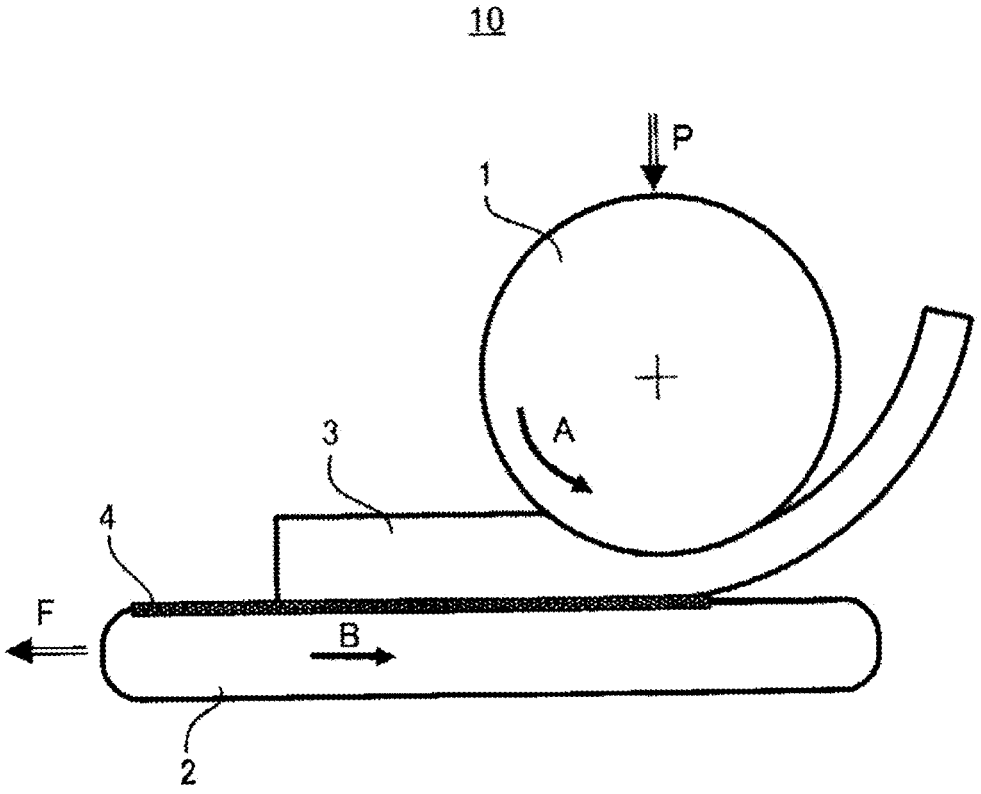
FIG. 2 is a schematic view illustrating a hot rolling testing apparatus used for evaluation in Examples and Comparative Examples as seen from a cross-sectional view.

The lubrication properties of each of the prepared powder lubricant compositions were evaluated by a hot rolling test. FIG. 2 is a schematic view illustrating a hot rolling testing apparatus 10 used in the evaluation as seen from a cross-sectional view. The up-and-down direction of the drawing of FIG. 2 is a vertical direction and a direction from the left side of the drawing of FIG. 2 to the right side of the drawing is a rolling direction. The hot rolling testing apparatus 10 shown in FIG. 2 includes a roll 1 and a plate-like tool 2. In the test, a heated material to be rolled 3 (corresponding to the work piece) was interposed between the plate-like tool 2 to which a graphite-based lubricant was applied (the plate-like tool 2 being movable in the rolling direction at a predetermined rate) and the roll 1 and was rolled to simulate a rolling state with a single stand in the mandrel mill. Then, the thrust force acting on the plate-like tool 2 in the rolling direction was measured. In FIG. 2, the arrow A represents a rotation direction of the roll 1, the arrow B represents a moving direction of the plate-like tool 2, the arrow P represents a pressing force loaded on the roll 1, and the arrow F represents a force loaded to keep the moving rate of the plate-like tool 2 constant against the thrust force acting on the plate-like tool 2. The place in which the lubricant of each Example and the lubricant of each Comparative Example are present is shown as a hatched portion indicated by the numerical reference 4.

Further, in addition to the measurement of the thrust force, after the test was completed, whether seizure occurred or not was confirmed by observing the surface of the plate-like tool 2 to evaluate the seizure properties of each lubricant.

As the material to be rolled, a plate of carbon steel (S25C) having a thickness of 10 mm was applied. The material to be rolled was heated to a predetermined temperature in a heating furnace and then taken out of the furnace. The powder lubricant composition was scattered on the surface of the material to be rolled on the side in which the material to be rolled was in contact with a plate-like tool, and immediately after the scattering, the material to be rolled was fed for rolling. As the plate-like tool, SKD6 with Cr plating was applied. As the graphite-based lubricant to be applied to the plate-like tool, a graphite-vinyl acetate-based lubricant was applied, in which the lubricant was applied to the plate-like tool with a brush. The heating was performed until the temperature reached 830° C. to 1200° C. in a nitrogen atmosphere. The rolling was performed under the conditions of a roll peripheral rate of 78.5 mm/s, a moving rate of the plate-like tool of 30 mm/s, and a reduction of 30%. The results are shown in Table 2.

The condition of a reduction of 30% with a single stand is a severe condition for lubrication. This is because a mill including 5 to 9 stands is used and a total reduction of 50% is achieved in typical mandrel mill rolling.

[Table 2]

In Table 2, the evaluation criteria for the hot rolling test results are as follows.

A: When the thrust force is 0.14 tons or less

B: When the thrust force is more than 0.14 tons and equal to 0.17 tons or less

C: When the thrust force is more than 0.17 tons and equal to 0.20 tons or less

D: When the thrust force is more than 0.20 tons

The lubricants with the evaluations A to C were defined as acceptable products and the lubricants with the evaluation D were defined as unacceptable products.

In Table 2, the evaluation criteria for the seizure resistance test results are as follows.

a: When there is no seizure b: When fine seizure which can be confirmed by observing a 10-times enlarged sample surface is generated c: When seizure which can be confirmed by observing the sample surface with the naked eyes is generated The lubricants with evaluation a or b were defined as acceptable products and the lubricants with evaluation c were defined as unacceptable products.

(Evaluation Results)

As shown in Table 2, the powder lubricant compositions of Examples 1 to 5 in which the blending ratio between borax and cryolite was within a range of 95:5 to 65:35 exhibited good lubrication properties in a wide temperature range. Among the lubricant compositions, the powder lubricant composition of Example 3 in which the blending ratio between borax and cryolite was within a range of 85:15 to 75:25 was able to reduce the thrust force to 0.14 tons or less, did not cause seizure, and exhibited very good lubrication properties in a wide temperature range from a low temperature of 750° C. to a high temperature of higher than 1000° C.

Contrarily, the powder lubricant composition of Comparative Example 1 containing only borax without cryolite exhibited poor lubrication properties in a low temperature range of lower than 1000° C. The powder lubricant composition of Comparative Example 4 containing a large amount of cryolite exhibited poor lubrication properties in a high temperature range of higher than 1000° C.

BRIEF DESCRIPTION OF THE REFERENCE SYMBOLS

10: HOT ROLLING TESTING APPARATUS

1: ROLL

2: PLATE-LIKE TOOL

3: MATERIAL TO BE ROLLED

4: LUBRICANT

S1: PIERCING ROLLING

S2: HEATING

S3: ADHERING POWDER LUBRICANT COMPOSITION

S4: ELONGATION ROLLING

S5: DRAWING

S6: POST-TREATING

S10: MANUFACTURING METHOD

TABLE 1

| COMPONENT | EXAMPLE 1 | EXAMPLE 2 | EXAMPLE 3 | EXAMPLE 4 | EXAMPLE 5 |
|---|---|---|---|---|---|
| BORAX | 95 | 90 | 80 | 70 | 65 |
| CRYOLITE | 5 | 10 | 20 | 30 | 35 |

| COMPONENT | COMPARATIVE EXAMPLE 1 | COMPARATIVE EXAMPLE 2 | COMPARATIVE EXAMPLE 3 | COMPARATIVE EXAMPLE 4 |
|---|---|---|---|---|
| BORAX | 100 | 97 | 63 | 60 |
| CRYOLITE | — | 3 | 37 | 40 |

UNIT: PARTS BY MASS

TABLE 2

| TEMPERATURE BEFORE INITIAL ROLLING (° C.) | EVALUATION | EXAMPLE 1 | EXAMPLE 2 | EXAMPLE 3 | EXAMPLE 4 | EXAMPLE 5 |
|---|---|---|---|---|---|---|
| 750 | THRUST FORCE | 0.136 | 0.099 | 0.107 | 0.117 | 0.122 |
| | SEIZURE RESISTANCE | A | A | A | A | A |
| | | a | a | a | a | a |
| 820 | THRUST FORCE | 0.173 | 0.153 | 0.134 | 0.14 | 0.143 |
| | SEIZURE RESISTANCE | C | B | A | A | B |
| | | a | a | a | a | a |
| 1080 | THRUST FORCE | 0.166 | 0.163 | 0.134 | 0.147 | 0.185 |
| | SEIZURE RESISTANCE | B | B | A | B | C |
| | | a | a | a | a | a |

| TEMPERATURE BEFORE INITIAL ROLLING (° C.) | EVALUATION | COMPARATIVE EXAMPLE 1 | COMPARATIVE EXAMPLE 2 | COMPARATIVE EXAMPLE 3 | COMPARATIVE EXAMPLE 4 |
|---|---|---|---|---|---|
| 750 | THRUST FORCE | 0.208 | 0.171 | 0.125 | 0.129 |
| | SEIZURE RESISTANCE | D | C | A | A |
| | | c | b | a | a |
| 820 | THRUST FORCE | 0.262 | 0.206 | 0.145 | 0.151 |
| | SEIZURE RESISTANCE | D | D | B | B |
| | | c | c | a | a |
| 1080 | THRUST FORCE | 0.184 | 0.188 | 0.201 | 0.202 |
| | SEIZURE RESISTANCE | C | C | D | D |
| | | b | b | c | c |

UNIT OF THRUST FORCE: ton

The invention claimed is:

1. A method for manufacturing a seamless steel pipe, comprising:

adhering a powder lubricant composition to a pipe inner surface of a work piece which is piercing rolled to have a tubular shape; and elongation rolling on the work piece after the adhering of the powder lubricant composition, wherein the powder lubricant composition comprises:

sodium borate: 65 parts by mass to 95 parts by mass;

cryolite: 5 parts by mass to 35 parts by mass; and at least one selected from the group consisting of a fatty acid sodium salt and a fatty acid calcium salt: 0 parts by mass to 25 parts by mass, wherein a total of sodium borate and cryolite is 100 parts by mass, and wherein a temperature of the work piece before initial rolling in the elongation rolling is 700° C. or higher and lower than 820° C.

2. The method for manufacturing a seamless steel pipe according to claim 1, wherein a total reduction in the elongation rolling is 50% to 80%.

3. The method for manufacturing a seamless steel pipe according to claim 2, wherein the elongation rolling is performed by a mandrel mill rolling.

4. The method for manufacturing a seamless steel pipe according to claim 1, wherein the elongation rolling is performed by a mandrel mill rolling.

5. The method for manufacturing a seamless steel pipe according to claim 1, wherein a concentration of the sodium borate in the powder lubricant composition is 70 parts by mass to 95 parts by mass, and a concentration of the cryolite in the powder lubricant composition is 5 parts by mass to 30 parts by mass.

6. The method for manufacturing a seamless steel pipe according to claim 1, wherein a concentration of the sodium borate in the powder lubricant composition is 70 parts by muss to 90 parts by mass, and a concentration of the cryolite in the powder lubricant composition is 10 parts by mass to 30 parts by mass.

7. The method for manufacturing a seamless steel pipe according to claim 1, wherein a concentration of the sodium borate in the powder lubricant composition is 70 parts by mass to 80 parts by mass, and a concentration of the cryolite in the powder lubricant composition is 20 parts by mass to 30 parts by mass.

8. The method for manufacturing a seamless steel pipe according to claim 1, wherein the total of sodium borate and cryolite is 80 mass % to 100 mass % of the powder lubricant composition.

9. The method for manufacturing a seamless steel pipe according to claim 1, wherein a concentration of the sodium borate in the powder lubricant composition is 65 parts by mass to 95 parts by mass, a concentration of the cryolite in the powder lubricant composition is 5 parts by mass to 35 parts by mass, and a concentration of the at least one selected from the group consisting of a fatty acid sodium salt and a fatty acid calcium salt is 5 parts by mass to 25 parts by mass.

10. The method for manufacturing a seamless steel pipe according to claim 1, wherein the elongation rolling starts when the work piece has a temperature of 700° C. or higher and lower than 820° C.

* * * * *